US005575314A

United States Patent [19]

Capitanio et al.

[11] Patent Number: 5,575,314

[45] Date of Patent: Nov. 19, 1996

[54] WEFT CUTTER FOR AIR LOOM WHICH IS CONTROLLABLE AS A FUNCTION OF WEAVING CONDITIONS

[75] Inventors: Roberto Capitanio, Castegnero; Gianluigi Sora, Vicenza; Zanrosso Mauro, Schio, all of Italy

[73] Assignee: Nuovo Pignone S.p.A., Florence, Italy

[21] Appl. No.: 443,455

[22] Filed: May 18, 1995

[30] Foreign Application Priority Data

May 20, 1994 [IT] Italy ..... MI94A1020

[51] Int. Cl.[6] ..... D03D 47/36; D03D 49/70

[52] U.S. Cl. ..... 139/429; 139/302; 83/605; 83/950

[58] Field of Search ..... 112/301, 300; 83/390, 382, 387, 605, 950; 139/170.4, 260, 263, 302, 116.1, 291 C, 429; 66/134, 140 R, 145 R

[56] References Cited

U.S. PATENT DOCUMENTS

| | | | |
|---|---|---|---|
| 3,250,237 | 5/1966 | Myska | 112/301 X |
| 3,696,770 | 10/1972 | Dunne et al. | 112/301 |
| 3,807,270 | 4/1974 | Wirz . | |
| 4,453,481 | 6/1984 | Garnett et al. | 112/301 |
| 4,531,555 | 7/1985 | Tatematsu et al. . | |

FOREIGN PATENT DOCUMENTS 0284766 10/1988 European Pat. Off. .

*Primary Examiner*—Andy Falik

*Attorney, Agent, or Firm*—Oblon, Spivak, McClelland, Maier & Neustadt, P.C.

[57] ABSTRACT

A weft cutter for an air loom in which a movable blade is hinged to the ram of a pneumatic cylinder which is pneumatically fed through a solenoid valve provided at its inlet with a pressure regulator. The ram is kept in a rest position by a return spring and the solenoid valve is directly piloted from a loom control console.

1 Claim, 2 Drawing Sheets

WEFT CUTTER FOR AIR LOOM WHICH IS CONTROLLABLE AS A FUNCTION OF WEAVING CONDITIONS

BACKGROUND OF THE INVENTION

1. Field of the Invention

The present invention relates to a weft cutter device for an air loom, which weft cutter, while being inexpensive, compact, operationally reliable and structurally simple, makes it possible for the cutting times to be promptly and directly controlled as a function of the weaving conditions and, above all, the cutting operation to be disabled at will, even while the loom is operating.

2. Discussion of the Background

It is well-known that in an air weaving loom the weft thread, drawn from a cop external to the loom, is entered into the open shed formed by the warp threads, from a plurality of nozzles and only after said warp threads have reversed the shed by mutually exchanging their position, so as to lock the inserted weft thread between them, said weft thread is cut by the weft cutting device, so as to disengage it from said cop.

According to the prior art, the weft cutter used is substantially constituted by a stationary blade with which a movable blade cooperates, by being caused to oscillate by a mechanical drive means of a cam type.

Unfortunately, besides not allowing a direct and fast selection of the cutting times without having to act on in the loom, because such a selection would require a manual action being performed inside the interior of the loom in order to disengage the fastening means of said cam onto its own shaft in order to suitably rotate said cam by a certain angle and finally to engage again said lock system, such a device known from the prior art does not even allow the cutting operation to be disabled during loom operation.

In order to obviate said drawbacks, said oscillation of the movable cam was accomplished by means of an electromechanical drive unit in which a stepper motor drives the motion of the movable blade through a suitable kinematic link means, or an electromagnetic drive means in which the movable blade is driven by the action of an electromagnet.

In fact, in these cases, the possibility is evident of selecting the cutting times and of disabling said cutting action at will, by suitably offsetting in time, or completely removing the motor or electromagnet biasing command. However, this latter type of weft cutters known from the prior art are affected by structural complexities which cause them to be rather expensive.

SUMMARY OF THE INVENTION

The purpose of the present invention is therefore of providing a weft cutter device which, with a simple, cheap, compact and operationally reliable structure makes it possible for the cutting times to be promptly and directly controlled as a function of the weaving conditions and, above all, for the cutting operation can be disabled at will, even while the loom is being operating.

The above purpose is substantially achieved by directly driving the movable blade by means of a pneumatic cylinder.

In fact, it is evident that with such a structure, it is enough that the attending operator directly intervenes, from the air loom control console, by use of a solenoid valve in order to schedule at will the intervention times of said cylinder and consequently the cutting times, as well as to disable said cutting action; on the other hand, with a simple pressure regulator installed at the inlet of said solenoid valve, it is also easily possible to vary the drive pressure fed to said pneumatic cylinder, and, consequently, the cutting force, as a function of the type of weft to be cut.

From the above, one will furthermore easily realize the extreme structural and functional simplicity of the device and, consequently, its inexpensive cost.

Summing-up, the weft cutter for an air loom, comprising a stationary blade cooperating with a movable blade which is caused to oscillate by a drive system, from a resting position to an active position, and vice-versa, is characterized according to the present invention in that said drive system is constituted by a pneumatic cylinder the ram of which is hinged to said movable blade and is urged to return back to its resting position by a return spring, which tends to keep said movable blade in its resting position, with said cylinder being pneumatically fed through a solenoid valve which can be controlled from the loom console and is provided with a pressure regulator at its inlet.

The present invention is better explained in the following by referring to the accompanying drawings, which illustrate a preferred embodiment supplied for merely exemplifying, non-limitative purpose, because technical or structural modifications can be supplied to it without departing from the scope of the present invention.

On the other hand, it is clear that, although the weft cutter was disclosed up to here with regard to cutting the weft inserted in the air loom, it can also be used whenever in the loom the cutting action must be disabled during one or more operating step(s) of the same loom, such as, e.g., in the case of false selvedge cutting, which may be carried out every two or more loom reed strokes, with consequent air saving.

DESCRIPTION OF THE PREFERRED EMBODIMENTS

Figure 1:
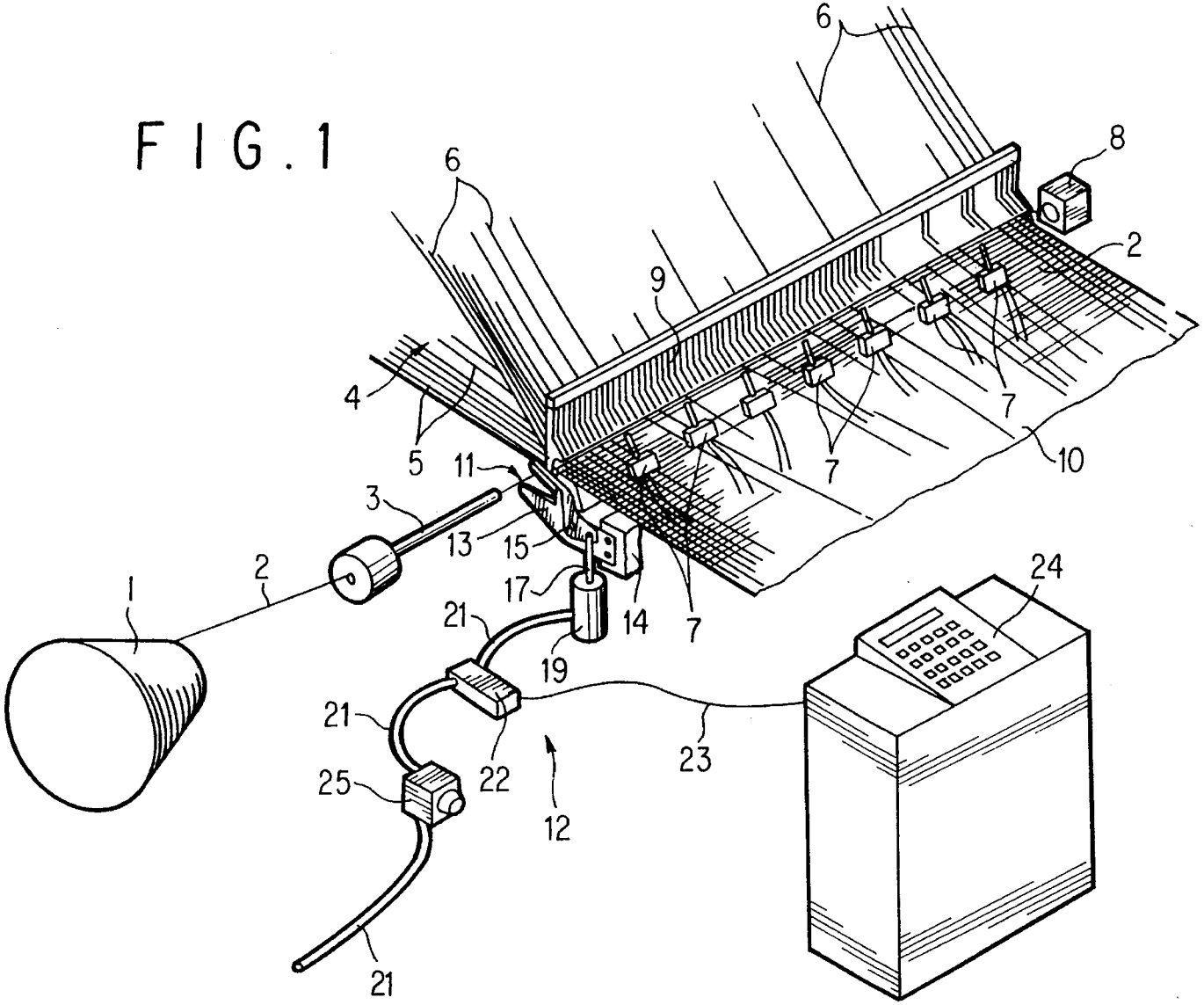
FIG. 1 schematically shows a perspective view of an air weaving loom using the weft cutting device according to the present invention.

Referring to the above Figures, what shows as external cop 1 to the air loom from which the weft thread (2) is taken which, by running through the main nozzle (3), is entered into the open shed (4) formed by the warp threads (5) and (6), from a plurality of nozzles (7) and is then caught by the suction device (8).

After that the reed (9) has beaten the inserted fill end against the longitudinal edge of the fabric (10) under way of formation, and the warp threads (5) and (6) have exchanged their mutual position thus locking said fill end in position between them, said fill end is cut at (11), close to the fabric (10) under way of formation, by the weft cutter (12) of the present invention.

Figure 2:
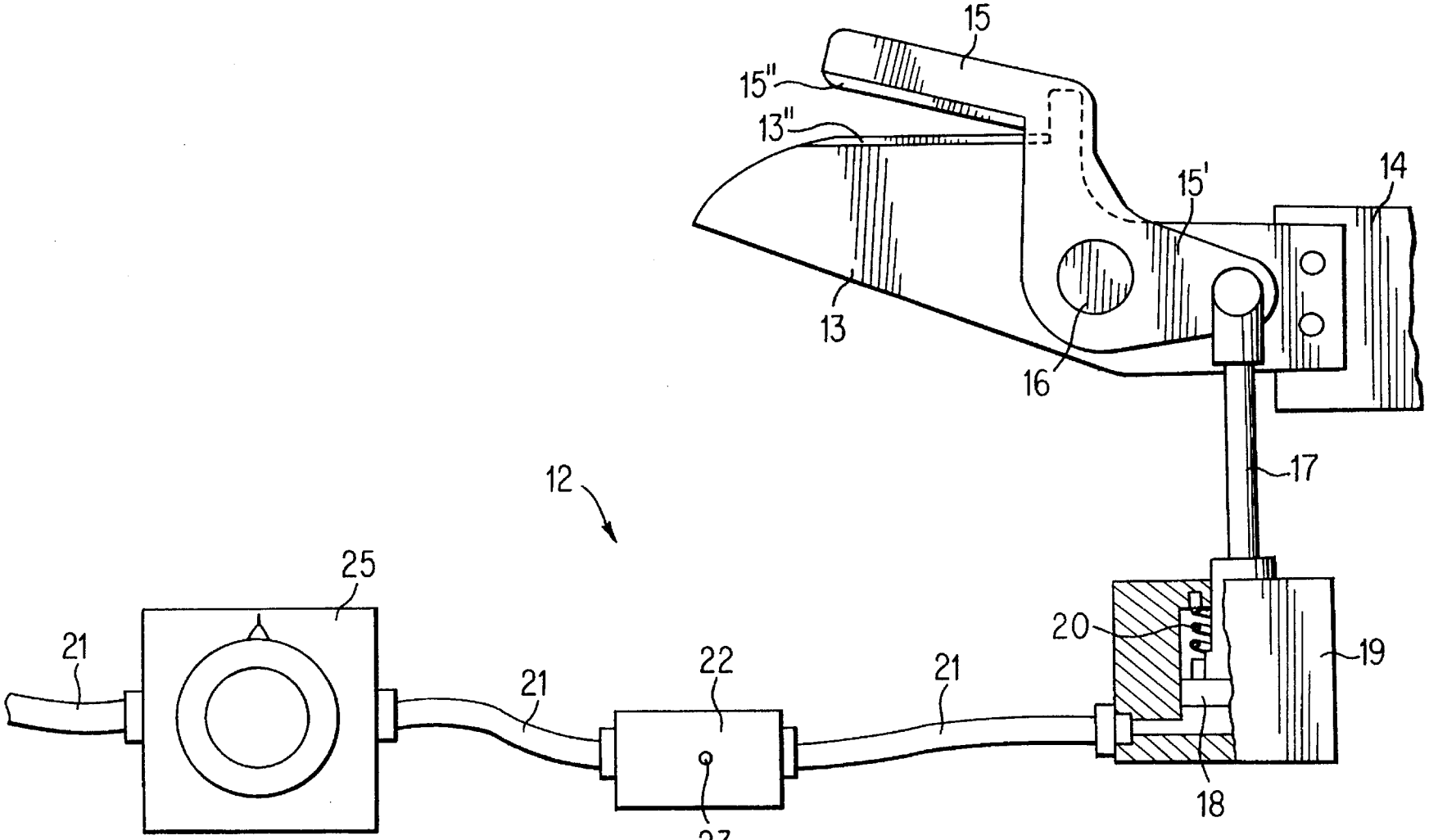
FIG. 2 shows a partially sectional side view, displayed on a greatly enlarged scale, of the weft cutter device of FIG. 1.

Said weft cutter (12) comprises a stationary blade (13) which, by being irremovably fastened onto the stationary body (14) of the loom, cooperates with a movable blade (15) which which is hinged at its middle point, in (16), onto the stationary blade (13) and, at its free end (15'), is hinged, in its turn, onto the stem (17) of the ram (18) of a pneumatic cylinder (19). Said ram (18) is then urged downwards by a return spring (20), thus tending to keep said mobile blade (15) in its resting position, i.e., with its cutting edge (15") being spaced apart from the cutting edge (13") of the stationary blade (13), as illustrated in FIG. 2.

Finally, said pneumatic cylinder (19) is fed by the air source, not depicted in the Figure, through the duct (21) through a solenoid valve (22) which is electrically piloted, through the wire (23), directly from the loom control console (24) and is provided, at its inlet, with a pressure regulator (25).

The method of operation of the device is by now evident.

After adjusting the operating pressure at the desired value by means of the pressure regulator (25), the movable blade (15) will perform its cutting operation every time (24) the solenoid valve (22) opening command is sent from the console; when said command is not sent, the return spring (20) will keep the movable blade (15) at its resting position.

We claim:

1. Weft cutter for an air loom, comprising:

a stationary blade cooperating with a movable blade adapted to be positioned in proximity with a reed of the loom;

a drive system oscillating said movable blade from a resting position to an active position, and vice-versa, wherein said drive system includes a pneumatic cylinder having a ram, a stem hinged to said movable blade and interconnecting the ram to the movable blade, and a return spring positioned in the pneumatic cylinder which biases said movable blade to return to a rest position, and a solenoid valve which pneumatically feeds said cylinder and which is adapted to be controlled from a loom console and includes a pressure regulator located at an inlet side of said solenoid valve, whereby cutting by the cutter is controlled from the loom console as a function of weaving conditions of the loom such that a cutting force of the movable blade is controllable as a function of the type of weft to be cut.

* * * * *